United States Patent [19]

Engleke

[11] 4,111,107

[45] Sep. 5, 1978

[54] DOUBLE WALLED SMOKESTACK APPARATUS

[76] Inventor: Donald J. Engleke, 31 Hewlett Rd., Towaco, N.J. 07082

[21] Appl. No.: 762,993

[22] Filed: Jan. 27, 1977

[51] Int. Cl.[2] ..... F23L 17/02

[52] U.S. Cl. ..... 98/60; 110/184; 138/92; 285/189; 285/223

[58] Field of Search ..... 98/58, 60; 110/184; 165/81; 285/189, 192, 223, 224, 226; 138/92

[56] References Cited

U.S. PATENT DOCUMENTS

| | | | |
|---|---|---|---|
| 1,978,608 | 10/1934 | Straty | 165/81 X |
| 2,011,018 | 8/1935 | Smith | 98/58 |
| 3,363,591 | 1/1968 | Lawrence | 110/184 |
| 3,368,506 | 2/1968 | Lawrence | 110/184 |
| 3,487,795 | 1/1970 | Lawrence | 98/60 X |
| 3,537,411 | 11/1970 | Roy | 110/184 |
| 3,547,202 | 12/1970 | Ticknor | 165/81 |
| 3,669,042 | 6/1972 | Lawrence | 110/184 |
| 3,727,566 | 4/1973 | Roy | 110/184 |
| 3,752,091 | 8/1973 | Lawrence | 110/184 |
| 3,780,639 | 12/1973 | Wood | 98/58 |
| 3,871,689 | 3/1975 | Zaderei et al. | 285/189 |
| 3,901,646 | 8/1975 | Coenders et al. | 285/226 X |

*Primary Examiner*—William E. Wayner
*Assistant Examiner*—William E. Tapolcai, Jr.
*Attorney, Agent, or Firm*—Marn & Jangarathis

[57] ABSTRACT

Double walled smokestack apparatus is provided in accordance with the teachings of the instant invention having substantially independent, load bearing inner and outer portions which are concentrically disposed to form a thermally insulating air space therebetween. This is achieved according to an exemplary embodiment by providing breeching and top cap arrangements intermediate the inner and outer portions which are configured in such manner to accommodate differential thermal expansion between the inner and outer portions without an attendant coupling of load. In addition, the inner and outer portions are fixedly interconnected proximate a mounting pad location where the moment of force of the inner shell is substantially zero.

26 Claims, 7 Drawing Figures

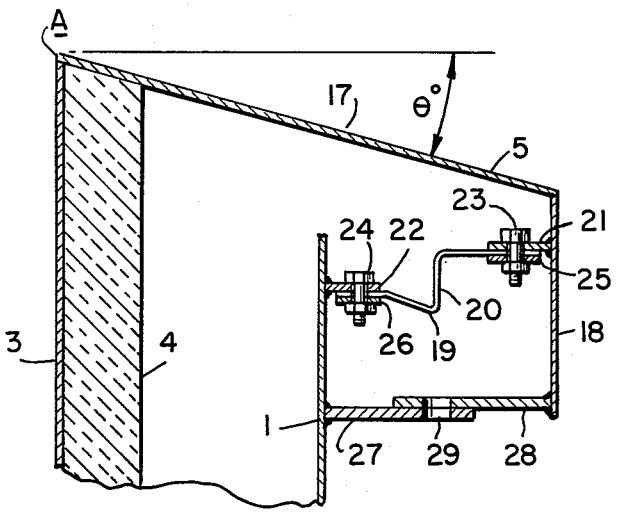
FIG. 2
FIG. 4
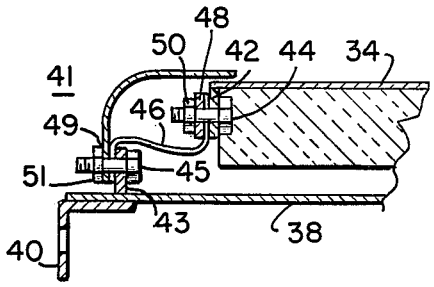
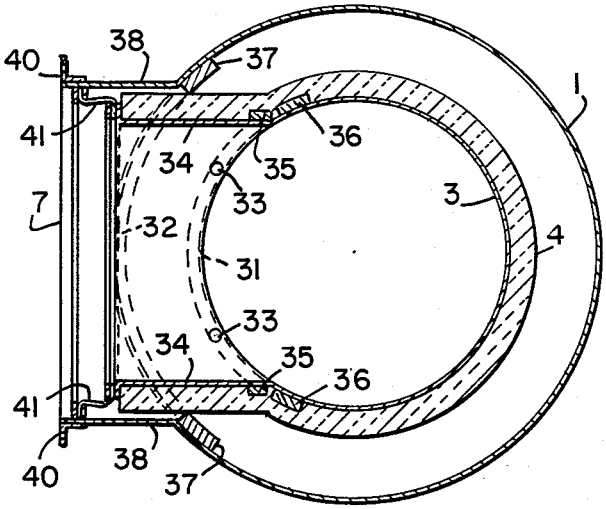
FIG. 3
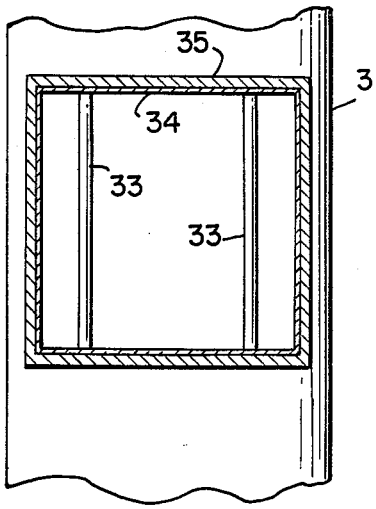
FIG. 5

DOUBLE WALLED SMOKESTACK APPARATUS

This invention relates to smokestack apparatus and more particularly to steel, double walled smokestack apparatus wherein inner wall portions of the stack apparatus and the breeching arrangement therefor are configured in such manner that inner wall portions of the resulting smokestack apparatus are completely load bearing.

Double walled or double shell forms of steel smokestack apparatus generally represent a preferred form of construction for industrial chimney equipment because the thermal insulating effect associated with air space intermediate the walls or shells markedly reduces the condensation of corrosive liquid at the inner shell. Due to the height of such industrial smokestack apparatus, windloading of the outer wall and substantial length variations between the inner and outer shells due to differential thermal expansion therebetween have been substantial problems with which designers of double walled, steel smokestack apparatus have had to contend. Typically, prior art solutions to these problems have been characterized by a preoccupation with expansive bracing structure intermediate the inner and outer shells of the double walled smokestack apparatus. The various forms of expansive bracing structure developed generally allowed the inner shell to expand differentially with respect to the outer shell while effectively coupling the inner shell to the outer shell at a plurality of locations in such manner that the inner shell was effectively non-load bearing. This preoccupation with supporting the inner shell with the outer shell has resulted in highly complex double walled steel smokestack apparatus which is quite expensive to fabricate and costly to erect. Furthermore, efforts to enhance the thermal insulation associated with the air space between the shells through the use of hermetic sealing techniques and the like have not only added to the complexity and cost of the resulting structure but in cases where preheating is not employed have been counterproductive because trapped condensate effectively acts to enhance the rate of corrosion.

Therefore, it is a principal object of the present invention to provide improved double walled smokestack apparatus and breeching arrangements therefor which are configured in such manner that inner wall portions of the resulting structure are completely load bearing and lend themselves to highly simplified fabrication techniques. Other objects and advantages of this invention will become clear from the following detailed description of several exemplary embodiments thereof, and the novel features will be particularly pointed out in conjunction with the appended claims.

In accordance with the teachings of the present invention double walled smokestack apparatus is provided having substantially independent, load bearing inner and outer portions which are concentrically disposed to form a thermally insulating air space therebetween; breeching and top cap arrangements intermediate said inner and outer portions are provided in such manner to accommodate differential thermal expansion between said inner and outer portions without an attendant coupling of load while said inner and outer portions are fixedly interconnected proximate a mounting pad location where the moment of force of the inner shell is substantially zero. The invention will be more clearly understood by reference to the following detailed description of several exemplary embodiments thereof in conjunction with the accompanying drawings in which:

FIG. 2 is a view, partially in section, illustrating details of the top cap structure which may be employed for the embodiment of the invention illustrated in FIG. 1;

FIG. 3 is a view, partially in section, illstrating details of a suitable breeching arrangement for the embodiment of the invention illustrated in FIG. 1;

FIG. 4 is a view, partially in section, illustrating expansion joint interconnection of inner and outer shells in the breeching arrangement shown in FIG. 3;

FIG. 5 is a view wherein the portions of the breeching arrangement associated with the inner shell of the embodiment of the double walled smokestack apparatus shown in FIG. 1 has been broken-out to illustrate the manner in which the same is reinforced;

Figure 1:
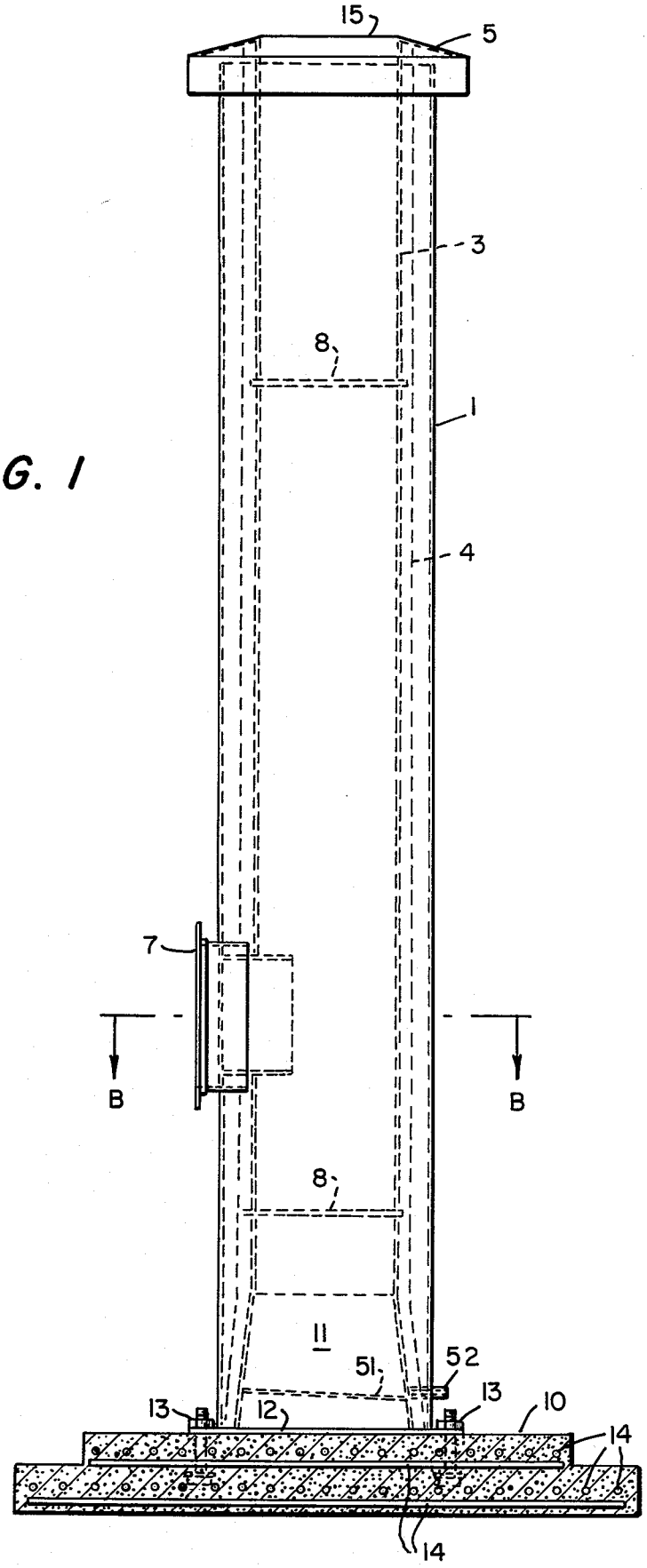
FIG. 1 is a side elevation of an exemplary embodiment of double walled smokestack apparatus in accordance with the teachings of the present invention.

Referring now to FIG. 1, there is shown a side elevation of an exemplary embodiment of double walled smokestack apparatus in accordance with the teachings of the present invention. The double walled smokestack apparatus illustrated in FIG. 1 comprises an outer shell 1, an inner shell 3, a top cap member 5, a breeching arrangement 7, reinforcing rods 8, and an erection pad 10. The outer shell 1 may be made of steel such as ordinary carbon steel or building type steel such as corten or mayari-r. The thickness of the outer shell would typically be a function of building codes and the height of the stack and thus for a 50 foot stack ordinary 10 guage material could be used throughout the entire outer shell 1. However, if higher stacks were being employed, the thickness of the outer shell may be reduced as a function of height to achieve material savings and such reduction could be initiated at the 10 or 12 foot mark or alternatively, a uniform thickness could be employed until the 50 foot mark is achieved and thereafter material reduction in thickness could be employed for succeeding sections. Although the outer shell 1 is shown as a unitary member once the same is in place, it will be appreciated by those of ordinary skill in the art that the assembly thereof may take place at the site from annular sections which may range in height from 6 to 12 feet and are welded in place to form the outer shell 1. If the height of the stack is such to warrant material reduction with increasing height, such material thickness reductions may be achieved by varying the thickness of the sections assembled to form the outer shell 1 of the stack. Thus, rather than a tapering effect, the thickness reductions would be preferably achieved in a stepwise manner which graduates as a function of the height of the section to be welded in place.

The inner shell 3 forms a completely independent, load bearing inner shell which is fabricated of either carbon steel, A-242, lined steel, plastic or stainless steel and preferably of such construction as to resist any thermal and/or corrosive atmospheres to which the same may be subjected. The thickness of the inner shell 3 may correspond to that of the outer shell or may be slightly thinner such that if 10 guage material were employed for the outer shell a 12 guage material may be employed for the inner shell and again, in typical 50 foot embodiments of the instant invention, the thickness of the inner shell 3 would be uniform while if higher smokestack apparatus were being erected, a thickness graduation in a stepwise manner, as was explained for the outer shell 1 above, could be employed to achieve material savings. This graduation, if warranted, could be initiated at a relatively low level in the stack, i.e., at the 4 or 8 foot mark or alternatively, could be initiated at the 50 ft. mark at the option of the designer. The assembly of the inner shell could proceed in the manner as was explained for the outer shell in that assembly may proceed through a welding together an annular sections having a height which may vary from 6 to 12 feet. Furthermore, stack assembly may be facilitated by the shipment and erection of concentrically disposed inner and outer shell annular sections which typically would be bolted together during shipment to assure appropriate spacing and have such bolt means removed subsequent to assembly at the site with adjacent sections. While the diameter and thickness of the inner and outer shells will vary as a function of height and application, in a typical 50 foot stack, the outer shell might have a diameter of 3ft 2in. i.d. while the inner shell would have a corresponding inside diameter of 2 ft.

The thermal insulating effect of the air gap formed intermediate the inner and outer shells 3 and 1 is enhanced by completely wrapping the outer periphery of the inner shell 3 in a blanket of insulating material 4 in the continuous manner indicated from the top to the bottom of the inner shell 3 or alternatively lining of the outer shell could be employed. The insulating material employed may take the form of matted glass fiber, asbestos, conventional fiberglas pads or similar other well known forms of insulating materials and in preferred embodiments of the instant invention, a substantial thickness of at least 2 inches of material is employed to further enhance the thermal insulating effect of the air gap established intermediate the inner and outer shells 1 and 3 and in addition thereto, to provide a heavily impeded air flow path under conditions where moisture is being attracted toward the inner shell 3 due to temperature differentials between the surface or proximate environment of the inner shell 3 and the external environment of the stack.

As shall become more apparent below, the inner and outer stacks are maintained as completely independent structures except for three areas of jointing which involve the top cap 5, the breeching arrangement 7, and the base portion 11 which is connected to the erection pad 10. The top cap 5 and breeching arrangement 7, as shall be seen more in detail below, are configured in such manner as to permit differential thermal expansion between the inner and outer shells 3 and 1 while not permitting any load sharing between the inner and outer shells to take place so that effectively, both the top cap 5 and breeching arrangement 7 are configured to maintain the independence of both the inner and outer shells 3 and 1. However, in the base area 11, the lowest portion of the inner shell 3 is configured in a frusto conical arrangement so as to approach in an aslant manner the inner periphery of the outer shell 1 in the manner illustrated in FIG. 1. The approach to the inner periphery of the outer shell 1 is preferably quite close so that at the bottom of the stack where both the inner and outer shells are attached to a base ring 12 only sufficient space remains between the inner and outer shells to accommodate the insulating material 4. The height of the frusto conical section of the inner shell 3 which defines the base area 11 may vary from 1 to 10 feet and typically exhibit a height of approximately 2 ft. At the bottom of the stack as indicated, both the inner and outer shells 3 and 1 are welded to the base ring 12 to provide a substantial support and the base ring is in turn mounted to the erection pad 10 by anchor bolts 13 or the like which are disposed about the periphery of the base ring 12. Although both the inner and outer shells 3 and 1 are welded to the base ring 12, it will be appreciated by those of ordinary skill in the art that the independence of the inner shell 3 is maintained because at the bottom of the stack the moment of force of the inner shell is zero for all practical purposes, hence no load sharing takes place. Thus, while welding to the base ring 12 represents a practical mode of mounting both the inner and outer shells to a mechanism for connection to the erection pad 10 from a dynamic standpoint, the independence of the outer and inner shells 1 and 3 is preserved with this mounting configuration.

The erection pad 10 may take the conventional form of a cement mounting pad which is reinforced in both directions by steel reinforcement rods 14 to serve as a conventional erection pad for the double walled smokestack apparatus disclosed herein. The base ring 12 is then interfaced to the top surface of the erection pad 10 with grout or similar other materials having a thickness which may approximate one inch and thereafter 8 or more anchor bolts 13 disposed about the periphery of the base ring 12 in the manner shown will suffice to adequately mount the double walled smokestack apparatus according to the instant invention to the erection pad 10. The anchor bolts 13 employed may typically take the form of 1¼ inches ASTM A-307 anchor bolts or other conventional anchor bolts of the type well known to those of ordinary skill in the art. Although mounting of the anchor bolts directly through the base ring 12 has been illustrated in FIG. 1, it will be appreciated by those of ordinary skill in the art that should excessive heights be employed for the smokestack apparatus illustrated in FIG. 1, an additional annular support ring may be mounted higher up on the periphery of the outer shell 1 and anchor bolts 13 disposed through both the base ring 12 and the additional ring employed may be utilized to achieve a more substantial mounting configuration. Alternatively, multi-plate welding techniques or attachment directly to the boiler and/or breeching could be employed for the mounting configuration.

The inner shell 3 is additionally provided, as illustrated in FIG. 1, with reinforcing rods 8 which are mounted about the inner shell 3 on a periodic basis to provide stiffening of the inner shell 3 so that the load bearing rigidity thereof is maintained through the entire height thereof. Since reinforcing rods 8 enhance the load bearing capability of the inner shell portion 3 and since the same do not come in contact with the outer shell 1 they in no way diminish the independence between the inner and outer shells 3 and 1. However, as will be apparent to those of ordinary skill in the art, both the reinforcing rods 8 and the flaring of the base of the inner shell at the lower portion thereof enhance the ability of the inner shell to accept substantial loading forces so that coupling to the outer shell need not be relied upon to enhance rigidity. In a typical 50 ft. embodiment of the instant invention, four reinforcing rods 8 were employed at 10 ft. intervals; however, it should be appreciated that as the height or internal diameter of the inner stack is increased, the periodicity at which reinforcing rods are imposed may be increased. Furthermore, the location of such reinforcing rods 8 should be intermediate the juncture of abutting sections as the welded nature of adjoined sections will provide a stiffening effect of their own and hence a preferred placement for the reinforcing rods 8 as will be readily appreciated by those of ordinary skill in the art is in the central portion of the section in which the same resides.

The top cap 5 is integrally connected through welding or the like to the top section of the inner shell 3 and is connected, in a manner to be described in greater detail below through an expansion joint or the like to the outer shell 1 so that vertical expansion of the inner shell with the outer shell 1 can be accommodated while displacement of the outer shell 1 with respect to the inner shell 3 due to wind loading and the like can be accommodated. The top cap 5 has an annular opening 15 which corresponds in diameter to the diameter of the top most section of the inner shell 3 which in the illustrated embodiment shown in FIG. 1 is not tapered. However, it will be appreciated by those of ordinary skill in the art that should it be desired to increase exit velocity as well as thermal lift, the top most section of the inner shell 3 may be provided with a conical section sloped inwardly to achieve this function and the top cap 5 would be provided with an annular opening corresponding to the exit aperture of such conical section. The constructional details of the top cap 5 are set forth in more detail in connection with FIG. 2.

Therefore, turning for the moment to FIG. 2, there is shown a view, partially in section, illustrating the details of the top cap structure which may be employed in the embodiment of the invention illustrated in FIG. 1. In FIG. 2, the outer shell 1, the inner shell 3, the insulating material 4 and the top cap 5 have been shown in partial section and have retained the same reference numerals employed in FIG. 1 so that the reader may appreciate the correspondence between the exemplary embodiment of the smokestack apparatus illustrated in FIG. 1 and the details of the top cap structure shown in FIG. 2. Thus, a perusal of the structure illustrated in FIG. 2 will render it apparent that the inner shell 3 exceeds the height of the outer shell 1 by some convenient length which may be taken as from 4 to 5 inches and is disposed downwardly so that flue gas lift is increased and the top cap 5 will cause particles which impinge thereon to flow away from the central portion of the inner shell 3 rather than into it. It should also be noted that the insulating material 4 is wrapped completely to the top of the inner shell 3 and is in an abutting relationship with the portion of the top cap 5 connected thereto. The top cap 5 may be welded at an appropriate angle theta ($\phi$) to the inner shell at the point indicated as A wherein the angle theta ($\phi$) represents some convenient value such as 15°. The resulting aslantly disposed portion 17 of the top cap is made of a suitable length so that it overlaps the outer shell 1 by a substantial distance such as 6 inches horizontally for each hundred feet of vertical stack or as otherwise required to thus provide adequate spacing for expansion and displacement of the inner and outer shells 3 and 1 in a horizontal direction. In addition, the aslant portion 17 of the top cap 5 should not closely approach the top most portion of the outer shell 1 to allow a sufficient interval for vertical expansion of the inner shell 3 with respect to the outer shell 1. It should also be noted that with the parameters set forth in an exemplary manner above, approximately 7 inches resides between the inner shell 3 and the outer shell 1 for each hundred feet of stack and this value is selected in practical embodiments of the instant invention from tables which set forth maximum values of wind loading as a function of the environment in which the stack is erected and the height of the stack. Thus, as will be readily appreciated by those of ordinary skill in the art, since essentially independent inner and outer shells are maintained within the smokestack apparatus according to the instant invention and further since the outer shell will suffer wind loading while the inner shell 3 does not, at the top portion of the stack, certain displacements will occur as a function of such wind loading in the horizontal interval between the inner shell 3 and the outer shell 1. Accordingly, under these circumstances, the spacing between the inner shell 3 and the outer shell 1 should be sufficient to permit such displacements as occur under wind loading without causing the inner and outer shells to touch. It may be further noted that the interval specified, i.e., 7 inches per hundred feet of stack is generally sufficient to accommodate all such wind loading factors.

The top cap 5 is also provided with a vertically disposed annular section 18 which extends a sufficient distance beneath the top of the outer shell to accommodate various interconnecting hardware to be described below, and to prevent driven weather and the like from being driven up under the cap through accessible areas which shall become more apparent below.

The vertically disposed member 18 is connected to the outer shell 1 of the exemplary smokestack apparatus through an expansion joint generally illustrated as 19. The expansion joint may be formed of a member 20 having a Z-shaped cross section as illustrated and made of asbestos, fiberglas matting or similar other materials depending upon design requirements and the anticipated temperatures. The member 20 may either be annular so as to completely circumscribe the periphery of the outer shell 1 or be periodically mounted about the periphery thereof in the form of strips of appropriate thickness. Regardless of the form preferred, the member 20 is secured to apertured protrusions 21 and 22 welded to both the vertically disposed member 18 and to the outer shell 1 in the manner indicated. The apertured protrusions 21 and 22 would preferably take the same form as the member 20 and hence would either be annularly discussed about the circumferences of the outer shell 1 and the vertically disposed member 18 or periodically disposed thereabout depending on the form selected for the member 20. The member 20 would then be mounted thereto through the nut and bolt sets 23 and 24 which would be periodically disposed about the periphery of the outer shell 1 and the vertically disposed member 18 to clamp the member 20 between the protrusions 21 and 22 and either a washer set or annular ring clamps 25 and 26 whose form would again vary depending upon whether or not the member 20 is an annular member or takes the form of strips periodically disposed about the periphery of the outer shell 1 and the vertically disposed member 18.

The expansion joint 19 thus formed with the Z-shaped member made of asbestos, fiberglas, or suitable other material will accommodate both vertical and horizontal displacements which occur between the inner and outer shells 3 and 1 due to such causes as thermal expansion characteristics, wind loading and the like. Thus, while differential thermal expansion will normally cause an upward displacement of the inner shell 3 with respect to the outer shell 1, such factors as wind loading and the like will cause a horizontal displacement of the outer shell 1 with respect to the inner shell 3 and such horizontal displacement may occur in both directions. Accordingly, the asbestos or fiberglas matting exhibiting the Z-shaped cross section illustrated in FIG. 2 will permit both vertical and horizontal displacements between the inner and outer shells 3 and 1 while maintaining the inner shell 3 totally independent of the outer shell 1 with respect to load sharing. Additionally, it should be noted that for horizontal displacements which may occur due to wind loading on the outer shell 1, the member 20 having the Z-shaped cross section illustrated and made of stiff fibrous materials such as fiberglas matting or asbestos, further acts as a damping member to quickly damp out oscillatory motions of the outer shell 1 with respect to the inner shell 3.

A further advantage of the expansion joint 19 illustrated in FIG. 2 which should be noted is that air flow between the insulating gap intermediate the inner and outer shells 3 and 1 and the environment external to the smokestack apparatus may be closely controlled thereby. This occurs due to the permeability of the material used for the member 20 in that the same acts to restrict the amount of air which may be sucked into the insulating area between the inner and outer shells as the inner shell cools down and conversely will allow condensate to be expelled as the surface of the inner shell heats up during preheating or actual use. Thus, by selecting the permeability of the member 20 to reside at appropriate values, the amounts of air taken in and expelled therethrough may be closely controlled and yet air flow is not completely prevented so that any condensates which do in fact collect in the air gap intermediate the inner and outer shells 3 and 1 are constantly being diluted. The control of the permeability of the member 20 may be achieved by varying the composition of the member 20, using compound structures therefor and/or periodically venting the member through the use of apertures or the like. Thus, for instance, the member 20 may be formed of asbestos backed with fiberglas, strong netting covered with asbestos or fiberglas matting or other suitable materials and when desired vents may be pre-drilled therethrough to assist in the control of air flow.

The top cap 5 may be fabricated in place on the top most section of the smokestack apparatus according to the instant invention if the same is to be assembled at the site in the form of preassembled concentrically disposed annular sections as aforesaid. Under these circumstances, to protect the integrity of the expansion joint 19, apertured flanges 27 and 28 would be periodically disposed about the periphery of the outer shell 1 and the vertically disposed member 18 in the manner illustrated in FIG. 2. Furthermore, the apertured flanges would be so configured that the apertured portions thereof 29 would overlap in the manner indicated in FIG. 2 and would have a bolt and nut set, not shown disposed therein. Subsequent to the erection of the smokestack apparatus at the site, the nut and bolt set would then be removed from the aperture 29 to allow free operation of the expansion joint 19 in the manner described above. Accordingly, it will be appreciated by those of ordinary skill in the art that the disposition of the top cap 5 and the interconnection thereof to the outer shell 1 through the expansion joint 19 maintains the integrity of the outer shell 1 and the inner shell 3 as independent load bearing members, while both vertical and horizontal displacement between the inner and outer shells 3 and 1 due to factors such as differential thermal expansion and wind loading are fully accommodated and in addition thereto, the expansion joint 19 acts to damp out oscillatory motions of the outer shell 1 which is subject to wind loading.

Returning now to FIG. 1, it will be seen that the only remaining interconnection between the outer shell 1 and the inner shell 3 occurs at the breeching arrangement 7 whereat, as well known to those of ordinary skill in the art, hot flue gases are introduced into the smokestack apparatus illustrated in FIG. 1 for expulsion to the atmosphere. The breeching arrangement 7 is configured using similar techniques to those employed for the top cap 5 to ensure a complete independence between the outer shell 1 and the inner shell 3 so that each member retains its identity as an independent load bearing member. Here however, the principal concern relates to a vertical displacement of the inner shell 3 with respect to the outer shell 1 due to differential thermal expansion and hence, substantial wind loading displacement at the breeching arrangement 7 need not be a substantial consideration. The breeching arrangement may best be appreciated through a consideration of FIG. 3 which is a view, partially in section, illustrating the details of a suitable breeching arrangement for the embodiment of the invention illustrated in FIG. 1.

Turning now to FIG. 3, there is shown a view, partially in section, illustrating the details of a suitable breeching arrangement for the embodiment of the invention illustrated in FIG. 1 as viewed from section lines BB in FIG. 1. The breeching aperture is formed in both the outer and inner shells 1 and 3 by cutting rectangular portions of the inner and outer shells away to form an opening suitable for the breeching arrangement. The cut away portions of the outer and inner shells are indicated by the dashed lines 31 and 32 in FIG. 3 and in a typical case, the inner aperture indicated by the dashed line 31 may be sized at approximately 1foot 8¼ inches sq. while the rectangular aperture cut in the outer shell 1 may be sized at 2 feet 2¼ inches sq. although, as will be appreciated by those of ordinary skill in the art the size of the aperture employed will be a function of the smokestack apparatus application and hence will vary with the purpose for which a design is being employed. It should be noted however, that when small breeching apertures are employed very little in the way of reinforcement bracing is required to retain the integrity of the outer shell 1 and the inner shell 3 while when larger apertures are employed, bracing should be utilized to reinforce the structure of the inner and outer shells and particularly that of the inner shell 3. The reinforcing members employed may typically take the form of reinforcement rods 33 which are disposed in the aperture in a vertical manner to retain the cross section of the aperture so that the structural strength of the inner shell 3 is retained while the aperture cross section retains the cut out configuration independent of stresses which may be imposed thereon so that an unimpeded gas flow path is provided. In addition, reinforced pipe is provided all about the aperture as well as the lead-ins thereto 34 as indicated by the cross sections of reinforcing pipe annotated 35–37.

More particularly, the reinforcing pipe sections 35 are wound about the rectangular lead-in 34 so as to reinforce the entire junction where such rectangular lead end is welded to the aperture cut in the inner shell 3. In addition, the aperture cut in both the inner shell 3 and the outer shell 1 is completely reinforced by the disposition of the reinforcing pipe sections 36 and 37 thereat. Typically, the reinforcing rods may take the form of 3 inches × ½ inch thick reinforcing members disposed in such manner as to retain the integrity of the inner shell 3 and the outer shell 1 at the locations where the square apertures have been cut. The disposition of the reinforcing rods 33 and the end pipe 35 may be best seen in FIG. 5 which is a view wherein the portion of the breeching arrangement associated with the inner shell of the embodiment of the double walled smokestack apparatus shown in FIG. 1 has been broken out to illustrate the manner in which the same is reinforced. Thus, turning to FIG. 5 to thus view the breeching aperture per se, it will be seen that the vertically disposed reinforcing rods 33 retain the structural rigidity of the inner shell 3 at the aperture while not impeding gas flow while the bent pipe supports 35 are wrapped completely about the junction of the lead-in members 34 to the inner shell 3 so as to provide complete reinforcement of the rectangular joint. In cases where the breeching aperture is small, deletion of the reinforcing members 33 and 35 may selectively take place.

Returning now to FIG. 3, it will be seen that the lead-in members 34 extend out past the periphery of the outer shell 1 so that a square conductor for introducing gas flow directly into the inner shell is provided at the opening of the breeching configuration. Furthermore, as will be apparent from FIG. 3, the outer portion of the lead-in structure 34 is provided with insulating material in the form of fiberglas mats or the like, so that the insulated character of the inner shell 3 is maintained throughout the breeching structure.

In similar manner to the inner shell 3, the rectangular cut out in the outer shell 1 is provided with a rectangular lead-in member 38 disposed parallely to the lead-in member for the inner shell. The lead-in member 38 is welded to the outer shell 1 at the rectangular cut out thereof and this cut out is reinforced, as will be recalled by the reinforcement pipes 37. The parallely disposed rectangular lead-in members 34 and 38 are thus maintained in essentially the same relationship as the outer and inner shells 1 and 3 in that the lead-in member 34 is insulated while an air space is additionally provided therebetween. An annular flange member 40 is provided at the entry point to the lead-in member 38 which serves as the connection point for conduits providing flue gases to the smokestack apparatus illustrated in FIG. 1. Periodic apertures are provided within the flange member 40 to accommodate the bolting of the breeching structure to conduit means from the furnace or other flue gas source.

The inner and outer rectangular lead-in members 34 and 38 are interconnected through an expansion joint 41 which is annularly disposed therebetween and will take on a square cross section in the same manner as the annular flange 40, and the lead-in members 34 and 38. The nature of the expansion joint 41 is much the same as the expansion joint described in connection with FIG. 2 in that it maintains the integrity and independent load bearing nature of both the inner shell 3 and the outer shell 1 through the breeching connection. The nature of the expansion joint 41 is best illustrated in FIG. 4.

Referring now to FIG. 4, there is shown a view, partially in section, illustrating expansion joint interconnection of inner and outer shells in the breeching arrangement shown in FIG. 3. More particularly, as shown in FIG. 4, both square lead-in members 34 and 38 are provided with an apertured protrusion about the periphery thereof which is welded in a transverse manner to the lead-in member 34 or 38. The apertured protrusion 42 is mounted, as indicated in FIG. 4, at the end portion of the lead-in member 34 while the apertured protrusion 43 is welded to the lead-in member 38 at a small distance from the end portion thereof which small distance is adequate to fully accommodate the length of a bolt and may typically be between 1 inch and 2 inch in from the end of the lead-in member 38. Both annular protrusions 42 and 43 have apertures periodically disposed therein to accept bolt members 44 and 45 in the manner indicated.

An expansion member 46 is annularly mounted intermediate the apertured protrusions 42 and 43 so as to completely close the opening therebetween entirely about the square entry area. In addition, an expansion shield 49 overlies the expansion member 46 to prevent flue gases from passing therethrough. The expansion member may be made of fibrous material such as asbestos or fiberglas matting or alternatively, compound members such as were described in conjunction with FIG. 2 may be employed it being appreciated that selective permeability which effectively assists in preventing flue gases from getting into the air gap between the inner and outer shells is preferred. Furthermore, since breathing is not a necessary requisite of the expansion member 46, metallics may be employed for the expansion member 46 such metallics taking the shape of sheet metal sections or the like formed in such manner as to exhibit a Z-shaped cross section. In addition, the square plate 48 and the base of the expansion shield 49 are periodically apertured about the periphery thereof to accept the shaft of the bolt members 44 and 45 which are employed to sandwich apertured portions in the expansion member 46 therebetween whereupon the mounting of the expansion member in the manner illustrated in FIG. 4 may be completed with nuts 50 and 51 in the manner illustrated. The expansion joint 41 illustrated in FIG. 4, as will be readily appreciated by those of ordinary skill in the art, maintains the complete independence of the inner and outer shells 3 and 1 through the breeching arrangement while permitting the introduction of flue gases into the smokestack apparatus illustrated. Additionally, the expansion joint 41 will accommodate both vertical and horizontal differential expansions of the inner shell 3 with respect to the outer shell 1 even though at the breeching location only vertical displacements associated with differential thermal expansion are significant.

While the expansion joint for the breeching arrangement illustrated in FIGS. 3 and 4 has been illustrated as using an expansion member 46, it will be appreciated by those of ordinary skill in the art that other techniques may be employed to maintain an independent load bearing relationship between the inner shell 3 and the outer shell 1 where, as in the breeching arrangement substantial venting is not to occur. Thus, for instance, slip joints could be employed to achieve a similar result.

Returning now to FIG. 1, it will be appreciated that additional structure may be provided in the exemplary embodiment of the smokestack apparatus depicted therein should the same be desirable. Thus, an indicated in the base section 11, an aslantly disposed drain pipe 51 and drain 52 may be provided so that periodic draining of moisture or other condensate from the base area between the inner and outer shells 3 and 1 and from the inner shell 3 per se can occur on a periodic basis. In addition, although not shown, a manhole opening can be provided just below the breeching structure to permit periodic cleaning of the flue within the smokestack apparatus disclosed. The manhole opening could be disposed near the base of the stack where expansion is not a substantial problem and would be similar in construction to the breeching arrangement described above except that the same would be provided with a pair of covers so that independence between the outer and inner shells is maintained. Additionally, if deemed desirable, a control panel may be provided at the base of the stack and the structure therefor could be employed to additionally strengthen the base area thereof. Thus it is seen that the exemplary embodiment of the invention illustrated in FIG. 1 provides improved double walled smokestack apparatus and breeching arrangements therefor which are configured in such manner that inner wall portions of the resulting structure are completely load bearing and lend themselves to highly simplified fabrication techniques.

In the exemplary embodiment of the invention illustrated in FIG. 1, the breeching apparatus disclosed took the form of a single port arrangement capable of accepting flue gases from a single conduit. However, under certain circumstances it is preferred to provide multiple entry breeching arrangements so that flue gases may be introduced from a plurality of sources or locations. Such an alternate arrangement can be provided utilizing the concepts of the instant invention and an exemplary embodiment of a multi-port breeching arrangement is illustrated in FIG. 6.

Figure 6:
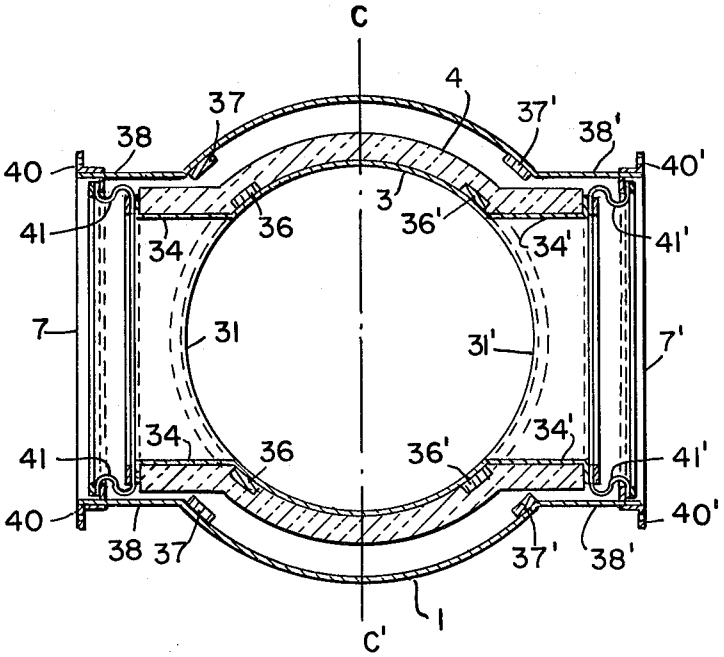
FIG. 6 is a view, partially in section, of an alternative breeching arrangement providing multiple entry to double walled smokestack apparatus in accordance with the teachings of the present invention.

Referring now to FIG. 6, there is shown a view, partially in section, of an alternative breeching arrangement which may be employed in the embodiment of the invention illustrated in FIG. 1. The alternative breeching arrangement illustrated in FIG. 6 provides multi-entry breeching structure for the double walled smokestack apparatus in accordance with the present invention and acts, as will now be appreciated by those of ordinary skill in the art to assure that the load bearing characteristics of the outer and inner shells 1 and 3 in the embodiment of the invention set forth in FIG. 1 are retained in an independent load bearing state. More particularly, in FIG. 6, a cross section of an exemplary multi-port breeching arrangement is shown which is symmetrical about the center line C—C'. The embodiment of the breeching arrangement illustrated in FIG. 6 is a two port arrangement; however, as will be readily appreciated by those of ordinary skill in the art, additional entry ports may be provided without deviating from the concepts of the instant invention. However, it should be noted that if additional ports are provided the size of individual ports should be reduced should the same represent a convenient design variable or alternately additional entry ports should be vertically displaced so as not to adversely effect the structural integrity of the resulting smokestack apparatus.

Turning specifically to FIG. 6, it will be seen that the structure therefor illustrated to the left of the center essentially corresponds to that shown for the breeching arrangement illustrated in FIG. 3 and hence corresponding reference numerals have been employed therein to identify corresponding structure. Thus, it will be seen that wherever corresponding reference numerals appear in FIG. 6, the structure thereof may be taken to correspond to that shown and described in conjunction with FIG. 3 and in addition, any variations therefor described in association with FIG. 3 may be utilized in the embodiment illustrated in FIG. 6.

In addition, the structure illustrated to the right of the center line C—C' in FIG. 6 is symetrical with that shown to the left of the center line and accordingly, corresponding structure to the right of the center line has been designated with primed reference numerals which correspond to the identical structure to the left of the center line C—C'. Accordingly, it will be appreciated that the two port breeching arrangement illustrated in FIG. 6 is formed by cutting rectangular openings 31 and 31' in the inner shell 3 and providing square lead-ins 34 and 34' as gas entry ways thereinto by welding the lead-ins 34 and 34' to the cut portions of the inner shell 3. Appropriate reinforcing rods are disposed at the cut portions of the inner shell 3 in the manner indicated by the reinforcing rods 36 and 36' and although not shown herein it will be appreciated that if appropriate, reinforcing rods and pipes 33 and 35 as illustrated in FIG. 3, may be additionally provided to maintain the structural integrity of the apertures cut in the inner shell 3. The lead-ins 34 and 34' are fully insulated by insulating material 4 in the manner described in conjunction with FIG. 3 and the cut portion of the outer shell 1 is provided with lead-ins 38 and 38' which are also reinforced by the reinforcing pipe 37 and 37' all in the manner described in connection with FIG. 3. Both the lead-ins 38 and 38' are provided with an annular flange 40 and 40' so that conduits for supplying flue gas from the furnace may be supplied thereto. In addition, an annular expansion joint 41 and 41' is provided for interconnecting the lead-ins 34 and 38 as well as lead-ins 34' and 38' so that the integrity of the inner shell 3 from the standpoint of being an independent load bearing member is retained in precisely the same manner described in connection with the single entry breeching arrangement shown herein. The expansion joint 41 and 41' illustrated in the multi-entry port embodiment for the breeching arrangement illustrated in FIG. 6 may take the same form as described in conjunction with FIG. 4. Accordingly, it will be appreciated by those of ordinary skill in the art that multi-entry breeching arrangements may be provided for the double walled smokestack apparatus according to the instant invention without adversely effecting the independent load bearing qualities of the inner shell or hence adversely effecting the ability of the breeching apparatus employed therewith to accommodate differential thermal expansion without coupling loads associated with the inner shell 3 to the outer shell 1. Furthermore, as shall be readily apparent to those of ordinary skill in the art, breeching apparatus having additional entry locations for flue gases may be provided either by reducing the size of the entry ports or vertically displacing individual ones or pairs of said ports to retain the structural integrity of the double walled smokestack apparatus.

Figure 7:
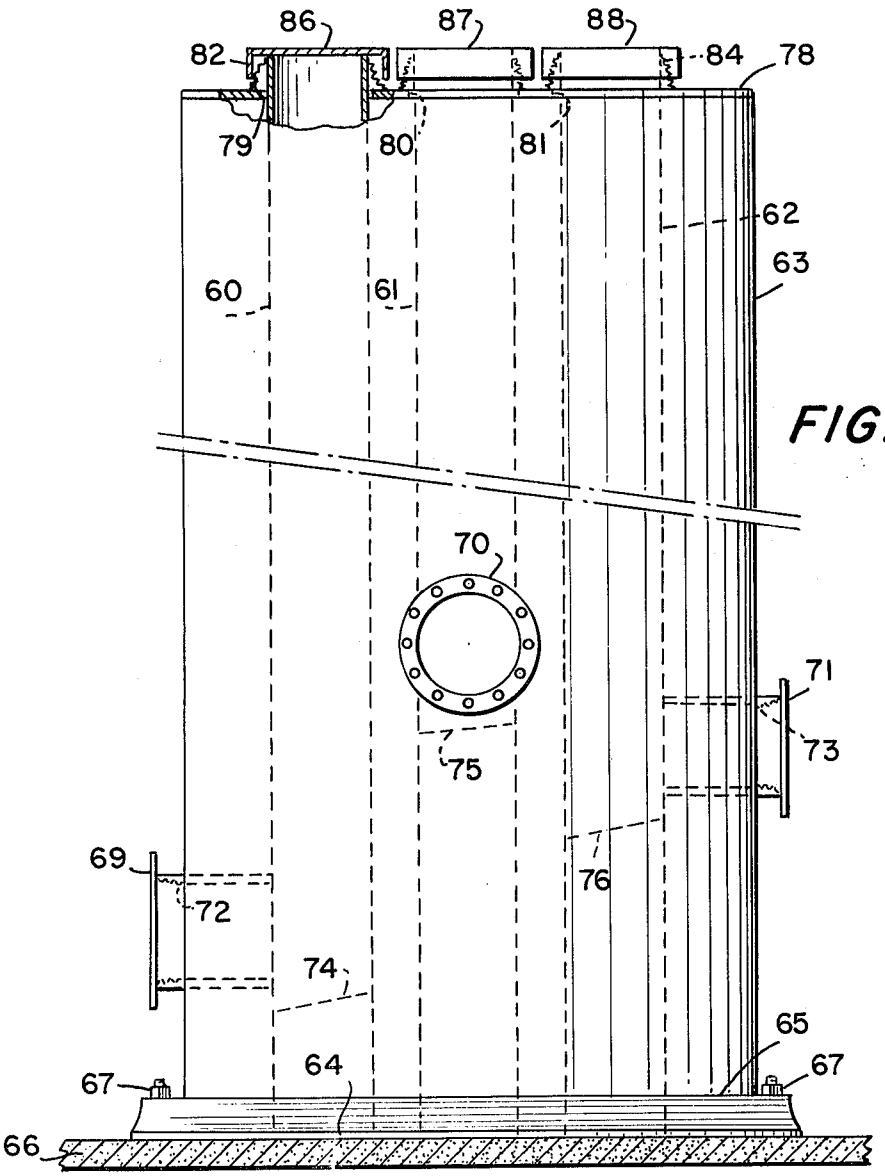
FIG. 7 is a side elevation of a multiple flue embodiment of double walled smokestack apparatus in accordance with the teachings of the present invention.

Referring now to FIG. 7, there is shown a side elevation of a multi-flue embodiment of the double walled smokestack apparatus in accordance with the teachings of the present invention. In essence in the multiple flue embodiment of the double walled smokestack apparatus illustrated in FIG. 7, three (3) independent inner shells 60, 61 and 62, each serving as a separate flue are disposed within an outer shell 63. The outer shell 63 may take the same form described in association with the outer shell 1 illustrated in FIG. 1 and may be made of substantially the same material. Similarly, each of the inner shells 60, 61 and 62 will exhibit a circular cross section and be made of the same materials mentioned in regard to the inner shell 3 described in FIG. 1. It should be noted however, that each of the inner shells 60, 61 and 62 may be made of different materials to lend additional flexibility to the double walled smokestack apparatus set forth and such materials may be particularly chosen to accommodate the flue gases to which an individual one of said inner shells are to be exposed. In addition, the diameter of each of the inner shells may be the same or dissimilar, it being noted that corresponding diameters for each of the inner shells 60, 61 and 62 will result in a more efficient utilization of the space within the outer shell 63. Although not shown in FIG. 7, each of the inner shells will have insulating material wrapped about the surface thereof in precisely the same manner as was described for the inner shell 3 illustrated in FIG. 1 and such insulating material may typically take the form of 2 inch fiberglas matting or the like. The diameter of the outer shell 63 will be such that it can accommodate three asymetrically disposed inner shells 60, 61 and 62 therein or alternatively, the form of the outer shell 63 may be elliptical in nature whereupon the inner shells would be disposed in a line. Each of the inner and outer shells 60–63 may be formed in 4 to 10 foot sections in the manner described in conjunction with FIG. 1 and it will be appreciated that the diameter of the outer shell 63 will be such as to provide an air gap of a certain minimum distance between the interior portion thereof and the outer wall of any of the inner shells 60, 61 and 62. This air gap, as was the case for the embodiment of the invention illustrated in FIG. 1 may typically be 7 inches per hundred feet to accommodate any wind loading imposed on the outer shell 63; however, depending upon the nature of the wind loading and the height of the multi-flue stack, lesser spacings may be readily utilized.

Each of the inner shells 60–62 as well as the outer shell 63 are welded to a base ring which provides a mounting platform at a location where the moment of force of the inner shell is substantially zero (0) as aforesaid. In addition, due to the additional forces involved, the outer periphery of the base ring 64 is built up to form an annular mounting cup 65 which provides additional support for the resulting smokestack assembly. The base ring 64 is disposed on top of a reinforced cement erection pad 66 which may take the form described in conjunction with FIG. 1 and the entire assembly is mounted thereto using annularly disposed anchor bolts 67. Thus, the multi-flue embodiment of the double walled smokestack apparatus depicted in FIG. 7 is erected and supported in much the same way described in regard to the single flue embodiment described in FIG. 1 as well as any of the alternates mentioned with respect thereto. Since the joining of the inner shell 60, 61 and 62 to the outer shell 63 at the base ring 64 is achieved at a point where the moment of force of the inner shell is substantially zero (0) each of the inner shells 60, 61 and 62 are maintained as independent load supporting members.

Each of the inner shells 60, 61 and 62 are provided with a breeching arrangement 69–71 which may take precisely the same form as was disclosed in connection with FIG. 1 wherein interconnection between the inner and outer shells respectively is achieved through the expansion joints indicated as 72 and 73 so that the independent load bearing nature of each of the inner shells 60–62 is retained while a breeching arrangement is provided therefor which may be connected through the flanges shown to conduits for introducing hot flue gases to be entered into the inner shells while such breeching arrangement can clearly accommodate differential thermal expansion due to temperature differentials associated with the individual inner shell 60, 61 or 62 to which that breeching arrangement is connected and the outer shell 63. Additionally, each of the inner shells may be periodically provided with reinforcing rods in the manner indicated by the dashed rods 74–76 which extend through the center thereof and assist, in the manner described in conjunction with FIG. 1, in maintaining the structural rigidity of the inner shell portion 60–62.

The outer shell portion 63 is provided with an apertured top plate 78 which closes the top portion of the stack off from the environment and is provided with a properly located aperture 79–81 to allow the inner shells 60, 61 and 62 associated therewith to pass therethrough leaving a displacement intermediate the periphery of the aperture and the periphery of the associated inner shell 60–62 which is sufficiently substantial to prevent the edge of the top cap 78 from coming into contact with the associated inner shell 60–62 at the apertures during wind loading. Thus, the diameter of the apertures in the top cap 78 would normally exceed the diameter of associated ones of the inner shells 60–62 by several inches it being appreciated by those of ordinary skill in the art that the number of inches of excess provided would be a function of the height of the stack and the anticipated wind loading to be imposed on the outer shell 63.

Each of the inner shells 60–62 passes through the top plate 78 and more particularly through the aperture therein 79–81 associated therewith so that the same is free to displace in a vertical direction due to differential thermal expansion associated with the temperature of the flue gas in that inner shell and the temperature of the outer shell 63 due to its ambient environment. Furthermore, it should be noted that as each of the inner shells 60–62 is not only an independent load bearing member with respect to the outer shell 63 but is also independent with respect to the other inner shells 60–62 no difficulties are encountered in accommodating differential thermal expansion associated with individual ones of the inner shells 60–62 due to the fact that flue gases therein are at different temperatures or that one or more of such inner shells is not receiving hot flue gases during a given interval.

Each of the inner shells 60, 61 and 62 is connected to the top plate 78 through an annular accordian-like expansion member 82–84 which may be made of folded asbestos, fiberglas mats or similar other materials including metallics and compound members such as those mentioned in conjunction with the embodiment of FIG. 1. However, the ability of the expansion member 82 to breathe is an important requisite and hence should metallics be used, the same would normally be periodically apertured and backed with fiberglas materials or the like so that the permeability thereof may be controlled. The sock type expansion member 82–84 would be mounted to both the top plate 78 and associated ones of the inner shells 60–62 in precisely the same manner described in association with the expansion joints illustrated in FIGS. 2 and 4 and it should be noted that while a sock type annular expansion joint is preferred in the multi-flue embodiment of the invention illustrated in FIG. 7, Z-type fibrous or metal expansion joints such as those shown in FIGS. 2 and 4 may be used as well.

When a sock type expansion joint 82–84 is employed in the multi-flue embodiment of the invention illustrated in FIG. 7, a top cover 86–88 is provided on the top of each of the inner shells 60–62 which is exposed and is configured to provide an aperture flush with the opening in the inner shell while providing an overhang sufficient to keep the sock expansion joint 82–84 clean as well as to completely overhang the apertures in the aperture top plate 78 to protect the same from the elements and the like. Alternatively, if Z-type expansion joints such as disclosed in FIG. 2 are employed, the top cover utilized for each of the inner shells 60–62 could take the form disclosed in detail in conjunction with FIG. 2.

While the instant invention has been disclosed in conjunction with several specific embodiments thereof, various modifications and variations thereof will become apparent to those of ordinary skill in the art. For instance, additional venting between the inner and outer shells for each embodiment of the double walled smokestack apparatus according to the instant invention could be provided by periodically inserting apertures or filtered vents in the outer shell at key locations. Alternatively, for applications where the breeching opening or manhole openings are so small with respect to the overall height of the stack that the opening represents a substantially non-expandable area when viewed with respect to the thermal expansion capabilities of the material and the temperatures involved, no isolation of the inner and outer shells through expandable joints will be required. Under these circumstances, rigid connection or connection through joints having only a minor degree of expansion would be permissible. Furthermore, should collections of condensates prove to be a real problem, drains may be periodically disposed about the bottom of the outer shell and apertures for the introduction of pressurized fluids such as air or the like may be provided at the upper or lower portion of the stack so that blow cleaning techniques may be readily employed. In addition, with respect to the multi-flue embodiment illustrated in FIG. 7, no cross bracing between the inner shells illustrated therein has been shown. However, should the operating characteristics of each flue or the parameters of the stack be such as to make cross bracing of the inner shells 60–62 desireable, the same may be provided through the introduction of cross bracing members or apertured plates disposed within the interior of the outer shell 63 without foresaking the independent nature of the inner shells with respect to the outer shells and such techniques may prove highly advantageous in cases where many flues or extremely high multi-flue stacks are involved. Similarly, in the multi-flue embodiment illustrated in FIG. 7 no flaring at the base portion has been illustrated; however, should such flaring be deemed desireable from a structural standpoint, each of the inner shells 60–62 may be flared at the base portions thereof in the same manner as was illustrated in FIG. 1 and to avoid excessive use of materials, the outer shell 63 may also be flared at the base portion thereof to accommodate the flaring of the inner shells 60–62 without any loss of the independent load bearing nature of the inner shells with respect to the outer shell.

It should also be noted that while the instant invention has been disclosed in conjunction with smokestack apparatus and breeching structure having rather specific configurations, other shapes, and particularly those involving cross-section may be conveniently employed. Thus the inner and outer shells and/or the breeching apertures and ducting may be rectangular, circular, oval, elliptical or conical in cross-section. Similarly, the shape of the smokestack apparatus when viewed frontally may be configured as a full-taper, a partial taper or a bottle shape to add further statutety.

While the invention has been described in connection with several exemplary embodiments thereof, it will be understood that many modifications will be readily apparent to those of ordinary skill in the art; and that this application is intended to cover any adaptations or variations thereof. Therefore, it is manifestly intended that this invention be only limited by the claims and the equivalents thereof.

What is claimed is:

1. In double-walled smokestack apparatus including inner shell means for receiving flue gases to be vented to the environment, outer shell means disposed about said inner shell means, said outer shell means having a cross-sectional extent which exceeds the cross-sectional extent of said inner shell to form a gap therebetween and insulating means disposed intermediate said inner shell and outer shell means, the improvement comprising:

means interconnecting said inner and outer shell means at a location of substantially zero moment of said inner shell means to base mounting structure;

breeching means for introducing flue gases through said outer shell means into said inner shell means for venting to said environment, said breeching means including first expansion joint means interconnecting said inner and outer shell means in such manner that substantially no load transference occurs therebetween; and top cap means interconnecting said inner and outer shell means at the top of said smokestack apparatus, said top cap means including second expansion joint means permitting displacement between said inner and outer shell means with substantially no load transfer taking place therebetween, said inner and outer shell means each being independent load bearing members having substantially no load transfer taking place therebetween.

2. The improved double walled smokestack apparatus according to claim 1 wherein said second expansion joint means permits vertical displacement of said inner shell means with respect to said outer shell means due to differential thermal expansion and horizontal displacements of said outer shell means with respect to said inner shell means due to wind loading.

3. The improved double walled smokestack apparatus according to claim 1 wherein said second expansion joint means has a selected permeability to allow limited air flow to said gap.

4. The improved double walled smokestack apparatus according to claim 1 wherein said top cap means is fixedly connected to the top of said inner shell and overlies the top of said outer shell, said second expansion joint means connecting an overlying portion of said top cap means to said outer shell.

5. The improved double walled smokestack apparatus according to claim 4 wherein said second expansion joint means takes the form of folded fibrous material fixedly connected to said overlying portion of said top cap means and to said outer shell.

6. The improved double walled smokestack apparatus according to claim 5 wherein said folded fibrous material is annularly disposed between said overlying portion of said top cap means and the periphery of said outer shell means.

7. The improved double walled smokestack apparatus according to claim 6 wherein said folded fibrous material includes asbestos matting.

8. The improved double walled smokestack apparatus according to claim 6 wherein said folded fibrous material includes fiberglas materials.

9. The improved double walled smokestack apparatus according to claim 1 wherein said breeching means comprises:

first aperture means disposed in said inner shell means;

second aperture means in said outer shell means oppositely disposed to said first aperture means; and first and second duct means fixedly mounted about said first and second apertures, said first and second duct means being concentrically disposed and extending in a direction outside of the periphery of said outer shell means to provide a breeching arrangement for inputting flue gases to be vented into said inner shell, said first expansion joint means interconnecting said first and second duct means and permitting displacement therebetween without any substantial transference of load.

10. The improved double walled smokestack apparatus according to claim 9 wherein said concentrically disposed first and second duct means are spaced apart to provide an insulating gap therebetween and additionally comprising insulating means disposed about said first duct means in said gap.

11. The improved double walled smokestack apparatus according to claim 9 wherein said first expansion joint means takes the form of fiberous material annularly disposed between said first and second duct means.

12. The improved double walled smokestack apparatus according to claim 11 wherein said first expansion joint means permits displacement of said inner shell and first duct means with respect to said outer shell and second duct means.

13. The improved double walled smokestack apparatus according to claim 12 wherein said fiberous material includes asbestos matting.

14. The improved double walled smokestack apparatus according to claim 9 additionally comprising reinforcement means disposed on said inner shell means proximate to said first aperture means and said first duct means.

15. The improved double walled smokestack apparatus according to claim 9 additionally comprising reinforcing rod means disposed in said first duct means at locations corresponding substantially to the periphery of said inner shell means.

16. The improved double walled smokestack apparatus according to claim 9 additionally comprising reinforcing means disposed about said first duct means adjacent to said inner shell means.

17. The improved double walled smokestack apparatus according to claim 9 additionally comprising:

third aperture means disposed in said inner shell means;

fourth aperture means in said outer shell means oppositely disposed to said third aperture means;

third and fourth duct means fixedly mounted about said third and fourth apertures, said third and fourth duct means being concentrically disposed and extending in a direction outside of the periphery of said outer shell means to provide another breeching arrangement for inputting flue gases to be vented into said inner shell; and third expansion joint means interconnecting said third and fourth duct means and permitting displacement therebetween without any substantial transference of load.

18. The improved double walled smokestack apparatus according to claim 1 wherein a base portion of said inner shell means is flared out to enhance the load bearing capacity thereof.

19. Doubled walled smokestack apparatus comprising:

a plurality of inner shell means for receiving flue gases to be vented to the environment;

outer shell means disposed about all of said plurality of inner shell means and forming a gap between interior portions of said outer shell means and exterior portions of each of said plurality of inner shell means;

insulating means disposed intermediate the periphery of each of said plurality of inner shell means and said outer shell means;

means interconnecting each of said plurality of inner shell means and said outer shell means at a location of substantially zero moment of said inner shell means to base mounting structure;

a plurality of breeching means for introducing flue gases through said outer shell means into associated ones of said plurality of said inner shell means for venting to said environment, each of said plurality of breeching means including first expansion joint means interconnecting said associated one of said inner shell means to said outer shell means in such manner that substantially no load transference occurs therebetween; and a plurality of top cap means interconnecting said associated ones of said plurality of inner shell means to said outer shell means at the top of said smokestack apparatus, each of said plurality of top cap means including second expansion joint means permitting displacement between an associated one of said plurality of inner shell means and said outer shell means with substantially no load transfer taking place therebetween, said plurality of inner shell means and outer shell means each being independent load bearing members having substantially no load transfer taking place therebetween.

20. The improved double walled smokestack apparatus according to claim 19 wherein each of said second expansion joint means permits vertical displacement of said associated one of said plurality of inner shell means with respect to said outer shell means and other ones of said plurality of inner shell means due to differential thermal expansion and horizontal displacement of said outer shell means with respect to each of said plurality of inner shell means due to wind loading.

21. The improved double walled smokestack apparatus according to claim 19 wherein each of said second expansion joint means has a selected permeability to allow limited air flow to said gap.

22. The improved double walled smokestack apparatus according to claim 19 wherein said outer shell means includes an apertured plate means affixed across the top portion thereof, said apertured plate means having a plurality of apertures therein, each of said plurality of apertures being associated with a respective one of said plurality of inner shell means and configured to permit said associated one of said plurality of inner shell means to pass therethrough with substantial clearance.

23. The improved double walled smokestack apparatus according to claim 22 wherein each of said second expansion joint means takes the form of folded fibrous material fixedly connected about an associated one of said plurality of inner shell means and to peripheral portions of said associated aperture in said apertured plate means.

24. The improved double walled smokestack apparatus according to claim 22 wherein said folded fiberous material includes asbestos matting; and each of said second expansion joint means taking a sock-like configuration overlying the top portion of an associated one of said plurality of inner shell means.

25. The improved double walled smokestack apparatus according to claim 19 wherein said each of said plurality of breeching means comprises:

first aperture means disposed in said associated one of said plurality of inner shell means;

second aperture means in said outer shell means oppositely disposed to said first aperture means; and first and second duct means fixedly mounted about said first and second apertures, said first and second duct means being concentrically disposed and extending in a direction outside of the periphery of said outer shell means to provide a breeching arrangement for inputting flue gases to be vented into said associated one of said plurality of inner shells, said first expansion joint means interconnecting said first and second duct means and permitting displacement therebetween without any substantial transference of load.

26. The improved double walled smokestack apparatus according to claim 25 wherein said first expansion joint means takes the form of fibrous material annularly disposed between said first and second duct means.

* * * * *